US009574249B2

(12) United States Patent
Omura et al.

(10) Patent No.: US 9,574,249 B2
(45) Date of Patent: Feb. 21, 2017

(54) METHOD FOR MANUFACTURING GRAIN ORIENTED ELECTRICAL STEEL SHEET

(75) Inventors: Takeshi Omura, Toyota (JP); Yasuyuki Hayakawa, Kurashiki (JP)

(73) Assignee: JFE STEEL CORPORATION, Tokyo (JP)

( * ) Notice: Subject to any disclaimer, the term of this patent is extended or adjusted under 35 U.S.C. 154(b) by 591 days.

(21) Appl. No.: 13/581,213

(22) PCT Filed: Feb. 22, 2011

(86) PCT No.: PCT/JP2011/000989
§ 371 (c)(1),
(2), (4) Date: Dec. 11, 2012

(87) PCT Pub. No.: WO2011/105054
PCT Pub. Date: Sep. 1, 2011

(65) Prior Publication Data

US 2013/0074996 A1 Mar. 28, 2013

(30) Foreign Application Priority Data

Feb. 24, 2010 (JP) ..... 2010-039389

(51) Int. Cl.
*C21D 8/02* (2006.01)
*C21D 8/12* (2006.01)
(Continued)

(52) U.S. Cl.
CPC ..... *C21D 8/0247* (2013.01); *C21D 8/1244* (2013.01); *C21D 8/1272* (2013.01); *C22C 38/008* (2013.01);
(Continued)

(58) Field of Classification Search
CPC ..... C22F 1/043; C22F 1/04; C22F 1/05; C22C 38/14; C22C 38/12; C22C 14/00; C22C 21/00
(Continued)

(56) References Cited

U.S. PATENT DOCUMENTS 4,898,626 A 2/1990 Shoen et al.
6,565,674 B1 5/2003 Kurosaki et al.
(Continued)

FOREIGN PATENT DOCUMENTS

CN 2463397 Y 12/2001
EP 0926250 A1 6/1999
(Continued)

OTHER PUBLICATIONS

May 24, 2011 International Search Report issued in International Patent Application No. PCT/JP2011/000989.
(Continued)

*Primary Examiner* — Jessee Roe
*Assistant Examiner* — Jenny Wu
(74) *Attorney, Agent, or Firm* — Oliff PLC

(57) ABSTRACT

A method includes preparing a steel slab in which contents of inhibitor components have been reduced, i.e. content of Al: 100 ppm or less, and contents of N, S and Se: 50 ppm, respectively; subjecting the steel slab to hot rolling and then either a single cold rolling process or two or more cold rolling processes interposing intermediate annealing(s) therebetween to obtain a steel sheet having the final sheet thickness; and subjecting the steel sheet to primary recrystallization annealing and then secondary recrystallization annealing. The primary recrystallization annealing includes heating the steel sheet to temperature equal to or higher than 700° C. at a heating rate of at least 150° C./s, cooling the steel sheet to a temperature range of 700° C. or lower, and
(Continued)

then heating the steel sheet to soaking temperature at the average heating rate not exceeding 40° C./s in a subsequent heating zone.

10 Claims, 3 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/60*** | (2006.01) |
| ***H01F 1/16*** | (2006.01) |
| *C21D 1/76* | (2006.01) |
| *C21D 9/46* | (2006.01) |

(52) U.S. Cl.
CPC ..... *C22C 38/02* (2013.01); *C22C 38/04* (2013.01); *C22C 38/06* (2013.01); *C22C 38/42* (2013.01); *C22C 38/60* (2013.01); *H01F 1/16* (2013.01); *C21D 1/76* (2013.01); *C21D 8/1266* (2013.01); *C21D 9/46* (2013.01); *C21D 2201/05* (2013.01)

(58) Field of Classification Search
USPC ..... 148/549, 688; 420/126, 417, 528
See application file for complete search history.

(56) References Cited

U.S. PATENT DOCUMENTS

| | | | | |
|---|---|---|---|---|
| 2002/0139444 | A1* | 10/2002 | Kosuge ..... | C21D 3/04 148/111 |
| 2004/0074565 | A1 | 4/2004 | Hayakawa et al. | |
| 2005/0224142 | A1 | 10/2005 | Hayakawa et al. | |

FOREIGN PATENT DOCUMENTS

| | | | | |
|---|---|---|---|---|
| EP | 1602738 | A1 | | 12/2005 |
| EP | 2 644 716 | A1 | | 10/2013 |
| JP | A-59-011626 | | | 1/1984 |
| JP | 61012823 | A | * | 1/1986 |
| JP | A-61-12823 | | | 1/1986 |
| JP | S66112823 | A | * | 1/1986 |
| JP | B2-03-57167 | | | 8/1991 |
| JP | A-06-049543 | | | 2/1994 |
| JP | B2-06-51887 | | | 7/1994 |
| JP | A-08-295937 | | | 11/1996 |
| JP | A-10-280040 | | | 10/1998 |
| JP | A-10-324922 | | | 12/1998 |
| JP | A-2000-345305 | | | 12/2000 |
| JP | A-2002-212687 | | | 7/2002 |
| JP | A-2003-096520 | | | 4/2003 |
| JP | B2-3707268 | | | 10/2005 |
| JP | A-2010-222631 | | | 10/2010 |
| KR | 10-0221789 | B1 | | 9/1999 |
| SU | 1139376 | A | | 2/1985 |
| TW | 589385 | B | | 6/2004 |

OTHER PUBLICATIONS

Office Action issued in Chinese Patent Application No. 201180015525.7 dated Jun. 4, 2013 (with translation).
Sep. 18, 2012 International Preliminary Report on Patentability issued in International Application No. PCT/JP2011/000989.
Mar. 7, 2014 Chinese Office Action issued in Chinese Application No. 201180015525.7 (with translation).
Feb. 7, 2014 Russian Office Action issued in Russian Application No. 2012140409 (with translation).
Feb. 3, 2014 Korean Office Action issued in Korean Application No. 10-2012-7022996 (with translation).
Jan. 14, 2014 Taiwanese Office Action issued in Taiwanese Application No. 100106228 (with translation).
Oct. 20, 2016 Search Report issued in European Patent Application No. 11747024.5.

* cited by examiner

METHOD FOR MANUFACTURING GRAIN ORIENTED ELECTRICAL STEEL SHEET

TECHNICAL FIELD

The present invention relates to a method for manufacturing a grain oriented electrical steel sheet and in particular to a method for manufacturing a grain oriented electrical steel sheet having very low iron loss.

PRIOR ART

An electrical steel sheet is widely used for a material of an iron core of a transformer, a generator and the like. A grain oriented electrical steel sheet having crystal orientations highly accumulated in {110}<001> Goss orientation, in particular, exhibits good iron loss properties which directly contribute to decreasing energy loss in a transformer, a generator and the like. Regarding further improving the iron loss properties of a grain oriented electrical steel sheet, such improvement can be made by decreasing sheet thickness of the steel sheet, increasing Si content of the steel sheet, improving crystal orientation, imparting the steel sheet with tension, smoothing surfaces of the steel sheet, carrying out grain-size refinement of secondary recrystallized grain, and the like.

JP-A 08-295937, JP-A 2003-096520, JP-A 10-280040 and JP-A 06-049543 disclose as technique for grain-size refinement of secondary recrystallized grain a method for rapidly heating a steel sheet during decarburization, a method for rapidly heating a steel sheet immediately before decarburization to improve texture of primary recrystallization (i.e. enhance the intensity of Goss orientation), and the like, respectively.

Incidentally, a slab must be heated at high temperature around 1400° C. in order to make inhibitor components contained in the slab fully cause good effects thereof, of reducing iron loss. This heating at high temperature naturally increases production cost. Accordingly, contents of inhibitor components in a steel sheet should be reduced as best as possible when the steel sheet is to be produced economically. In view of this, JP-B 3707268 discloses a method for manufacturing a grain oriented electrical steel sheet using a material not containing precipitation inhibitor components like AlN, MnS and MnSe (which material will be referred to as an "inhibitor-free" material hereinafter).

DISCLOSURE OF THE INVENTION

Problems to be Solved by the Invention

However, it turned out that, when the technique of improving texture of primary recrystallization by the rapid heating treatment described above is applied to a method for manufacturing a grain oriented electrical steel sheet by using an inhibitor-free material, secondary recrystallized grain of the resulting steel sheet fails to be refined and an effect of decreasing iron loss cannot be obtained as expected in some applications.

Considering the situation described above, an object of the present invention is to propose a method for stably achieving a good iron loss reducing effect by rapid heating treatment of a steel sheet in a case where primary recrystallization annealing including the rapid heating treatment is carried out in a method for manufacturing a grain oriented electrical steel sheet using an inhibitor-free material.

Means for Solving the Problem

The inventors of the present invention investigated factors causing failure in grain-size refinement of secondary recrystallized grain in a case where primary recrystallization annealing including rapid heating treatment is carried out in a single continuous annealing line and discovered that uneven temperature distribution in the widthwise direction of a steel sheet, generated by rapid heating, is an important factor of causing the failure. Specifically, grain-size refinement of secondary recrystallized grain smoothly proceeded when the rapid heating treatment and the primary recrystallization annealing were separately carried out in separate facilities, experimentally. It is assumed regarding the successful result of this experimental case that temperature of a steel sheet dropped to around the room temperature over the period of transfer between the facilities, thereby eliminating unevenness in temperature distribution in the widthwise direction generated by the rapid heating. In contrast, in a case where the rapid heating treatment and the primary recrystallization annealing of a steel sheet are carried out in a single continuous annealing line, unevenness in temperature distribution in the widthwise direction of the steel sheet is not eliminated even at the soaking stage of primary recrystallization annealing, thereby resulting in uneven diameters, in the widthwise direction, of primary recrystallized grains of the steel sheet and thus failure in obtaining a desired iron-loss reducing effect. This problem may not be so conspicuous when the steel sheet contains inhibitors because grain growth is suppressed by the inhibitors. However, an inhibitor-free steel sheet tends to be significantly affected by relatively minor unevenness in temperature distribution because the steel sheet lacks precipitates (inhibitors) which suppress grain growth.

The inventors of the present invention discovered in this regard that it is critically important to: design a facility system for primary recrystallization annealing of a grain oriented electrical steel sheet such that the facility system has a structure capable of rapidly heating, then cooling, heating again and soaking, e.g. that the facility system includes rapid heating zone, first cooling zone, heating zone, soaking zone and second cooling zone; and specifically control in particular conditions of the first cooling zone and the heating zone. Results of the experiments, on which the aforementioned discovers are based, will be described hereinafter.

<Experiment 1>

A steel slab containing a component composition (chemical composition) shown in Table 1 was produced by continuous casting and the slab was subjected to heating at 1200° C. and hot rolling to be finished to a hot rolled steel sheet having sheet thickness: 1.8 mm. The hot rolled steel sheet thus obtained was subjected to annealing at 1100° C. for 80 seconds. The steel sheet was then subjected to cold rolling so as to have sheet thickness: 0.30 mm. A cold rolled steel sheet thus obtained was subjected to primary recrystallization annealing in a non-oxidizing atmosphere. This primary recrystallization annealing included: first rapidly heating the cold rolled steel sheet by direct heating (electrical resistance heating) to temperature in the range of 600° C. to 800° C. at a heating rate, i.e. a temperature-increasing rate, in the range of 20° C./s to 300° C./s ("° C./s" represents "° C./second" in the present invention); then heating the steel sheet by indirect heating (gas heating by radiant tube heaters) to 900° C. at the average heating rate of 55° C./s; and retaining the steel sheet at 900° C. for 100 seconds. "Temperature" represents temperature at the center portion in the widthwise direction of the steel sheet in Experiment 1.

TABLE 1

| C(%) | Si(%) | Mn(%) | Al(ppm) | N(ppm) | S(ppm) | Se(ppm) |
|---|---|---|---|---|---|---|
| 0.003 | 3.1 | 0.3 | 35 | 18 | 10 | <<10 |

The texture of primary recrystallization was evaluated. Specifically, the texture of primary recrystallization of the resulting steel sheet was evaluated according to 2D intensity distribution at a ($\phi_2$=45°) cross section in Euler space in the center layer in the sheet thickness direction of the steel sheet. Intensities (degrees of accumulation) of primary recrystallized orientations can be grasped at this cross section. FIG. 1 shows relationships between the heating rate of the rapid heating vs. intensities of Goss orientation ($\phi$=90°, $\phi_1$=90°, $\phi_2$=45°) and relationships between the end-point temperature of the rapid heating vs. intensities of Goss orientation. It is understood from Experiment 1 that a heating rate need be at least 150° C./s and the end-point temperature need be 700° C. or higher in order to reliably change texture (i.e. to enhance Goss orientation) of primary recrystallization by rapid heating in an inhibitor-free steel sheet.

<Experiment 2>

A steel slab containing a component composition shown in Table 2 was produced by continuous casting and the slab was subjected to heating at 1400° C. and hot rolling to be finished to a hot rolled steel sheet having sheet thickness: 2.3 mm. The hot rolled steel sheet thus obtained was subjected to annealing at 1100° C. for 80 seconds. The steel sheet was then subjected to cold rolling so as to have sheet thickness: 0.27 mm. A cold rolled steel sheet thus obtained was subjected to primary recrystallization annealing in an atmosphere having oxidizability as the ratio of partial pressure of moisture with respect to partial pressure of hydrogen ($PH_2O/PH_2$), of 0.35. This primary recrystallization annealing was carried out by following two methods.

Method (i)

Method (i) included: rapidly heating the cold rolled steel sheet to 800° C. at the heating rate of 600° C./s by electrical resistance heating; cooling to one of 800° C. (i.e. no cooling), 750° C., 700° C., 650° C., 600° C., 550° C. and 500° C.; then heating the steel sheet to 850° C. at the average heating rate of 20° C./s by gas heating using radiant tube heaters; and retaining the steel sheet at 850° C. for 200 seconds. Cooling was carried out by introducing gas for cooling into the system (gas cooling).

Method (ii)

Method (ii) included: heating the cold rolled steel sheet to 700° C. at the average heating rate of 35° C./s and then to 850° C. at the average heating rate of 5° C./s by gas heating using radiant tube heaters; and retaining the steel sheet at 850° C. for 200 seconds.

TABLE 2

| Sample ID | C(%) | Si(%) | Mn(%) | Al(ppm) | N(ppm) | S(ppm) | Se(ppm) |
|---|---|---|---|---|---|---|---|
| A | 0.07 | 2.85 | 0.02 | 40 | 25 | 5 | <<10 |
| B | 0.07 | 2.85 | 0.02 | 280 | 70 | 5 | <<10 |

Each of the resulting steel sheet samples thus obtained was coated with annealing separator containing MgO as a primary component and subjected to finish annealing. The finish annealing was carried out at 1200° C. for 5 hours in dry hydrogen atmosphere. The steel sheet thus finish annealed had unreacted annealing separator removed therefrom and was provided with a tension coating constituted of 50% colloidal silica and magnesium phosphate, whereby a final product sample was obtained. "Temperature" represents temperature at the center portion in the widthwise direction of the steel sheet in Experiment 2.

The maximum temperature difference in the widthwise direction of each steel sheet sample was measured at completion of the rapid heating, completion of the cooling, and completion of the soaking, respectively, and iron loss properties ("iron loss properties" represents the average value thereof in the sheet widthwise direction in the present invention) of an outer winding portion of a resulting product coil were analyzed for evaluation in Experiment 2. Table 3 shows the temperature distributions in the widthwise direction of each steel sheet sample at completions of the respective rapid heating, cooling and soaking processes. The rapid heating process generated unevenness (maximally 50° C.) in temperature distribution in the widthwise direction of the steel sheet sample. Further, the lower end-point temperature of the steel sheet sample after the cooling process generally resulted in the less unevenness in temperature distribution in the widthwise direction of the steel sheet sample after the cooling and soaking processes.

TABLE 3

| | | At completion of rapid heating | | At completion of cooling | | At completion of soaking | | |
|---|---|---|---|---|---|---|---|---|
| Sample ID | Annealing pattern | End-point temperature at the widthwise center portion (° C.) | Maximum temperature difference in the widthwise direction (° C.) | End-point temperature at the widthwise center portion (° C.) | Maximum temperature difference in the widthwise direction (° C.) | End-point temperature at the widthwise center portion (° C.) | Maximum temperature difference in the widthwise direction (° C.) | Iron loss $W_{17/50}$(W/kg) |
| A | Method (ii) | | Absence of rapid heating | | | 851 | 2 | 0.95 |
| | Method (i) | 802 | 50 | 801 | 50 | 851 | 15 | 0.92 |
| | | 801 | 48 | 751 | 40 | 852 | 8 | 0.90 |
| | | 800 | 51 | 699 | 20 | 851 | 5 | 0,84 |
| | | 803 | 46 | 648 | 16 | 851 | 3 | 0.83 |
| | | 799 | 50 | 598 | 14 | 852 | 3 | 0.83 |
| | | 801 | 52 | 549 | 12 | 852 | 2 | 0.82 |
| | | 800 | 51 | 500 | 10 | 852 | 2 | 0.83 |
| B | Method (ii) | | Absence of rapid heating | | | 851 | 2 | 0.95 |
| | Method (i) | 804 | 49 | 799 | 48 | 850 | 17 | 0.85 |
| | | 803 | 48 | 748 | 38 | 850 | 9 | 0.85 |

TABLE 3-continued

| Sample ID | Annealing pattern | At completion of rapid heating: End-point temperature at the widthwise center portion (° C.) | At completion of rapid heating: Maximum temperature difference in the widthwise direction (° C.) | At completion of cooling: End-point temperature at the widthwise center portion (° C.) | At completion of cooling: Maximum temperature difference in the widthwise direction (° C.) | At completion of soaking: End-point temperature at the widthwise center portion (° C.) | At completion of soaking: Maximum temperature difference in the widthwise direction (° C.) | Iron loss $W_{17/50}$(W/kg) |
|---|---|---|---|---|---|---|---|---|
| | | 800 | 49 | 703 | 21 | 851 | 5 | 0.84 |
| | | 798 | 50 | 652 | 17 | 852 | 4 | 0.84 |
| | | 799 | 50 | 603 | 15 | 852 | 3 | 0.84 |
| | | 800 | 49 | 555 | 12 | 851 | 2 | 0.83 |
| | | 800 | 52 | 499 | 9 | 850 | 1 | 0.83 |

FIG. 2 shows relationship between the maximum temperature difference in the widthwise direction of an inhibitor-free steel sheet sample after soaking vs. iron loss properties of an outer winding portion of a resulting product coil. As shown in FIG. 2, temperature difference in the widthwise direction of the steel sheet sample after soaking in particular significantly affects iron loss properties of a resulting product coil and must not exceed 5° C. in order to reliably obtain good iron loss properties in chemical composition A (sample ID A) having a component composition not containing any inhibitor. It has been revealed in connection therewith that the end-point temperature of the inhibitor-free steel sheet must be once dropped to 700° C. or lower after the rapid heating. Incidentally, the inhibitor-free steel sheet samples not subjected to rapid heating (i.e. those processed by Method (ii)) each exhibited much poorer iron loss properties in spite of very good temperature distribution in the widthwise direction thereof after the soaking process.

Temperature difference in the sheet widthwise direction after soaking does not significantly affect iron loss of chemical composition B (sample ID B) having a component composition containing inhibitors, as shown in FIG. 3.

<Experiment 3>

A steel slab containing a component composition shown in Table 4 was produced by continuous casting and the slab was subjected to heating at 1100° C. and hot rolling to be finished to a hot rolled steel sheet having sheet thickness: 2.0 mm. The hot rolled steel sheet thus obtained was subjected to annealing at 950° C. for 120 seconds. The steel sheet was then subjected to cold rolling so as to have sheet thickness: 0.23 mm. A cold rolled steel sheet thus obtained was subjected to primary recrystallization annealing in an atmosphere having oxidizability ($PH_2O/PH_2$) of 0.25. This primary recrystallization annealing was carried out by following two methods.

Method (iii)

Method (iii) included: rapidly heating the cold rolled steel sheet to 730° C. at the heating rate of 750° C./s by direct heating (induction heating); cooling to 650° C. by gas cooling; then heating the steel sheet to 850° C. at respective average heating rates in the range of 10° C./s to 60° C./s by indirect heating (gas heating via radiant tube heaters); and retaining the steel sheet at 850° C. for 300 seconds.

Method (iv)

Method (iv) included: heating the cold rolled steel sheet to 700° C. at the average heating rate of 60° C./s and then to 850° C. at respective average heating rate in the range of 10° C./s to 60° C./s by indirect heating (gas heating via radiant tube heaters); and retaining the steel sheet at 850° C. for 300 seconds.

TABLE 4

| C(%) | Si(%) | Mn(%) | Al(ppm) | N(ppm) | S(ppm) | Se(ppm) |
|---|---|---|---|---|---|---|
| 0.07 | 3.25 | 0.15 | 20 | 20 | 10 | <<10 |

Each of the resulting steel sheet samples thus obtained was coated with annealing separator containing MgO as a primary component and subjected to finish annealing. The finish annealing was carried out at 1200° C. for 5 hours in dry hydrogen atmosphere. The steel sheet thus finish annealed had unreacted annealing separator removed therefrom and was provided with a tension coating constituted of 50% colloidal silica and magnesium phosphate, whereby a final product sample was obtained. "Temperature" represents temperature at the center portion in the widthwise direction of the steel sheet in Experiment 3.

The maximum temperature difference in the widthwise direction of each steel sheet sample was measured at completion of the rapid heating, completion of the cooling, and completion of the soaking, respectively, and iron loss properties of an outer winding portion of a resulting product coil were analyzed for evaluation in Experiment 3. Table 5 shows the temperature distributions in the widthwise direction of each steel sheet sample at completions of the respective rapid heating and soaking processes. The steel sheet samples prepared according to Method (iv) not involving the rapid heating process unanimously exhibited the maximum temperature difference after soaking, of 5° C. or less. In contrast, the heating rate in the heating zone must not exceed 40° C./s in order to eliminate unevenness in temperature distribution in the widthwise direction of the steel sheet caused by the rapid cooling (in other words, the desired iron loss properties cannot be obtained when the heating rate exceeds 40° C./s) in the steel sheet samples prepared according to Method (iii) involving the rapid cooling process. Accordingly, it is reasonably concluded that the heating rate in the heating zone must not exceed 40° C./s.

TABLE 5

| Annealing pattern | | At completion of rapid heating Maximum temperature difference in the widthwise direction (° C.) | Average heating rate in heating zone (° C./s) | At completion of soaking End-point temperature at the widthwise center portion (° C.) | At completion of soaking Maximum temperature difference in the widthwise direction (° C.) | Iron loss $W_{17/50}$ (W/kg) |
|---|---|---|---|---|---|---|
| Method (iii) | With rapid heating | 60 | 10 | 850 | 2 | 0.78 |
| | | 61 | 20 | 850 | 2 | 0.77 |
| | | 59 | 30 | 850 | 3 | 0.78 |
| | | 58 | 40 | 849 | 4 | 0.79 |
| | | 60 | 45 | 850 | 7 | 0.85 |
| | | 60 | 50 | 849 | 8 | 0.85 |
| | | 61 | 60 | 851 | 8 | 0.86 |
| Method (iv) | Without rapid heating | — | 10 | 849 | 2 | 0.86 |
| | | — | 20 | 848 | 2 | 0.87 |
| | | — | 30 | 850 | 3 | 0.86 |
| | | — | 40 | 851 | 1 | 0.88 |
| | | — | 45 | 850 | 1 | 0.86 |
| | | — | 50 | 848 | 2 | 0.88 |
| | | — | 60 | 849 | 2 | 0.88 |

It has been newly revealed from the analyses described above that one of the most important points in maximizing the iron loss properties-improving effect caused by rapid heating treatment in production of a grain oriented electrical steel sheet using an inhibitor-free material resides in elimination no later than completion of the soaking process, of rapid heating-derived unevenness in temperature distribution in the widthwise direction of a steel sheet.

The present invention has been contrived based on the aforementioned discoveries and primary features thereof is as follows.

(1) A method for manufacturing a grain oriented electrical steel sheet, comprising the steps of:

preparing a steel slab having a composition including C: 0.08 mass % or less, Si: 2.0 mass % to 8.0 mass %, Mn: 0.005 mass % to 1.0 mass %, Al: 100 ppm or less, N, S and Se: 50 ppm, respectively, and balance as Fe and incidental impurities;

rolling the steel slab to obtain a steel sheet having the final sheet thickness; and subjecting the steel sheet to primary recrystallization annealing and then secondary recrystallization annealing, wherein Al, N, S and Se constitute inhibitor components to be reduced, and the primary recrystallization annealing includes heating the steel sheet to temperature equal to or higher than 700° C. at a heating rate of at least 150° C./s, cooling the steel sheet to a temperature range of 700° C. or lower, and then heating the steel sheet to soaking temperature at the average heating rate not exceeding 40° C./s.

(2) The method for manufacturing a grain oriented electrical steel sheet of (1) above, wherein oxidizability of an atmosphere, represented by $PH_2O/PH_2$, under which the primary recrystallization annealing is carried out is set to be 0.05 or lower.

(3) The method for manufacturing a grain oriented electrical steel sheet of (1) or (2) above, wherein the composition of the steel slab further includes at least one element selected from Ni: 0.03 mass % to 1.50 mass %,
Sn: 0.01 mass % to 1.50 mass %,
Sb: 0.005 mass % to 1.50 mass %,
Cu: 0.03 mass % to 3.0 mass %,
P: 0.03 mass % to 0.50 mass %,
Mo: 0.005 mass % to 0.10 mass %, and
Cr: 0.03 mass % to 1.50 mass %.

(4) The method for manufacturing a grain oriented electrical steel sheet of any of (1) to (3) above, wherein the rolling step comprises subjecting the steel slab to hot rolling and then either a single cold rolling process or two or more cold rolling processes interposing intermediate annealing(s) therebetween to obtain a steel sheet having the final sheet thickness.

(5) A facility system for recrystallization annealing of a grain oriented electrical steel sheet, comprising:

rapid heating zone;
first cooling zone;
heating zone;
soaking zone; and
second cooling zone.

Effect of the Invention

According to the present invention, it is possible to stably manufacture a grain oriented electrical steel sheet having remarkably good iron loss properties by using an inhibitor-free material which allows a slab to be heated at relatively low temperature.

BEST EMBODIMENT FOR CARRYING OUT THE INVENTION

Figure 1:
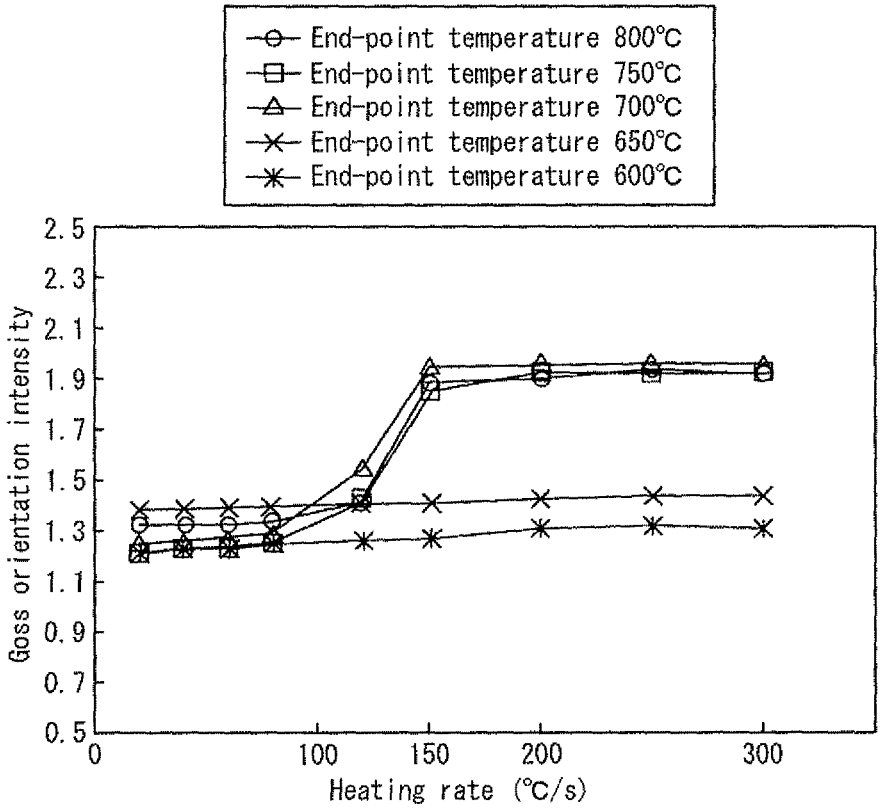
FIG. 1 is a graph showing relationship between: the heating rate during primary recrystallization annealing; and Goss intensity.
Figure 2:
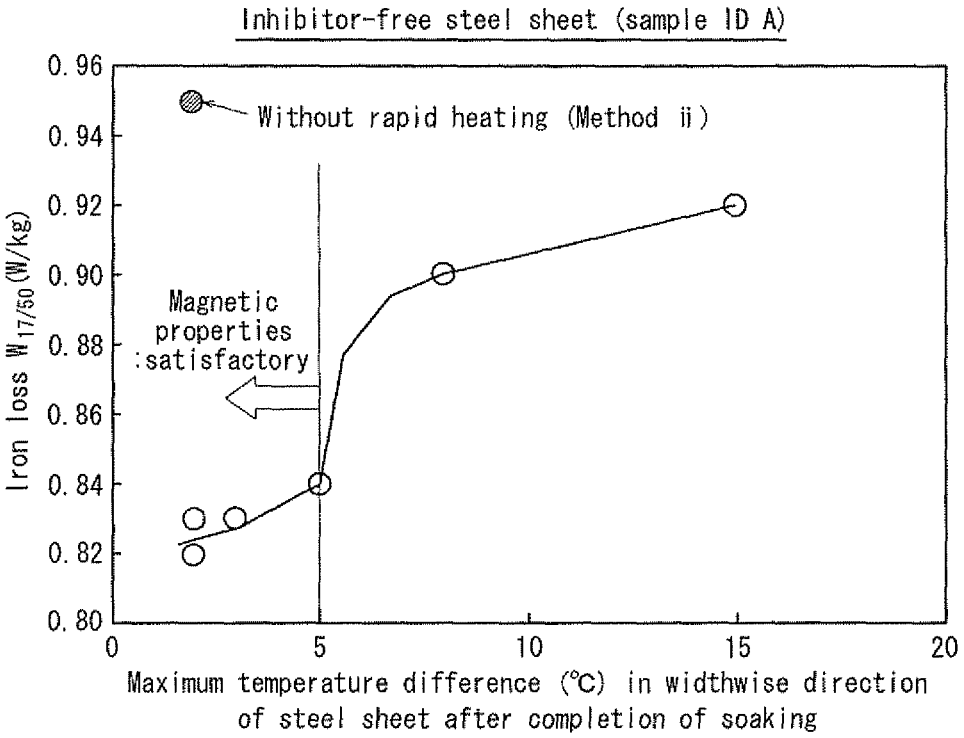
FIG. 2 is a graph showing relationship between: the maximum temperature difference in the widthwise direction of a steel sheet using an inhibitor-free material after soaking; and iron properties of an outer winding portion of a resulting product coil.
Figure 3:
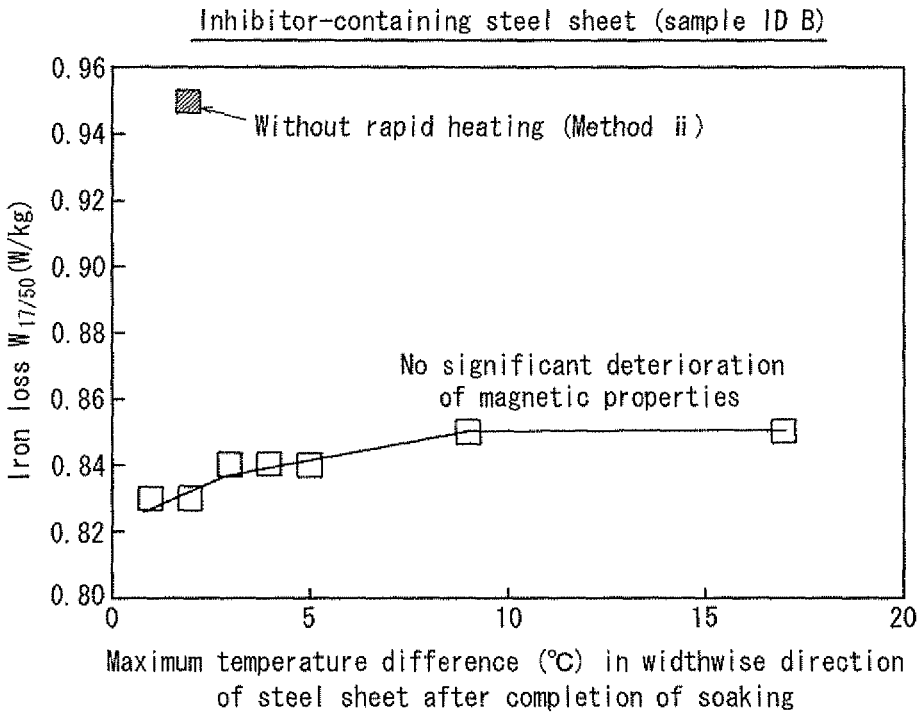
FIG. 3 is a graph showing relationship between: the maximum temperature difference in the widthwise direction of a steel sheet using an inhibitor-containing material after soaking; and iron properties of an outer winding portion of a resulting product coil.

Next, reasons for why the primary features of the present invention should include the aforementioned restrictions will be described.

Reasons for why components of molten steel for manufacturing an electrical steel sheet of the present invention are to be restricted as described above will be explained hereinafter. Symbols "%" and "ppm" regarding the components represent mass % and mass ppm, respectively, in the present invention unless specified otherwise.

C: 0.08% or less

Carbon content in steel is to be restricted to 0.08% or less because carbon content in steel exceeding 0.08% makes it difficult to reduce carbon in a production process to a level of 50 ppm or below at which magnetic aging can be safely avoided. The lower limit of carbon is not particularly required because secondary recrystallization of steel can occur even in a steel material containing no carbon. The lower limit of "slightly above zero %" is industrially acceptable.

Si: 2.0% to 8.0%

Silicon is an effective element in terms of enhancing electrical resistance of steel and improving iron loss properties thereof. Silicon content in steel lower than 2.0% cannot achieve such good effects of silicon sufficiently. However, Si content in steel exceeding 8.0% significantly deteriorates formability (workability) and also decreases flux density of the steel. Accordingly, Si content in steel is to be in the range of 2.0% to 8.0%.

Mn: 0.005% to 1.0%

Manganese is an element which is necessary in terms of achieving satisfactory hot workability of steel. Manganese content in steel lower than 0.005% cannot cause such a good effect of manganese. However, Mn content in steel exceeding 1.0% deteriorates magnetic flux of a product steel sheet. Accordingly, Mn content in steel is to be in the range of 0.005% to 1.0%.

Contents of inhibitor components need be reduced as best as possible because a steel slab containing inhibitor components exceeding the upper limit must be heated at relatively high temperature around 1400° C., resulting in higher production cost. The upper limits of contents of inhibitor components, i.e. Al, N, S, and Se, are therefore Al: 100 ppm (0.01%), N: 50 ppm (0.005%), S: 50 ppm (0.005%), and Se: 50 ppm (0.005%), respectively. These inhibitor components are reliably prevented from causing problems as long as the contents thereof in steel stay not exceeding the aforementioned upper limits, although contents of the inhibitor components are preferably reduced as best as possible in terms of achieving good magnetic properties of the steel.

The composition of the steel slab may further include, in addition to the components described above, at least one element selected from Ni: 0.03% to 1.50%, Sn: 0.01% to 1.50%, Sb: 0.005% to 1.50%, Cu: 0.03% to 3.0%, P: 0.03% to 0.50%, Mo: 0.005% to 0.10%, and Cr: 0.03% to 1.50%.

Nickel is a useful element in terms of improving microstructure of a hot rolled steel sheet for better magnetic properties thereof. Nickel content in steel lower than 0.03% cannot cause this good effect of improving magnetic properties in a satisfactory manner, while nickel content in steel exceeding 1.50% makes secondary recrystallization of the steel unstable to deteriorate magnetic properties thereof. Accordingly, nickel content in steel is to be in the range of 0.03% to 1.50%.

Sn, Sb, Cu, P, Cr and Mo are each useful elements in terms of improving magnetic properties of steel. Each of these elements, when content thereof in steel is lower than the aforementioned lower limit, cannot sufficiently cause the good effect of improving magnetic properties of the steel, while content thereof in steel exceeding the aforementioned upper limit may deteriorate growth of secondary recrystallized grain of the steel. Accordingly, contents of these elements in the electrical steel sheet of the present invention are to be Sn: 0.01% to 1.50%, Sb: 0.005% to 1.50%, Cu: 0.03% to 3.0%, P: 0.03% to 0.50%, Mo: 0.005% to 0.10%, and Cr: 0.03% to 1.50%, respectively. At least one element selected from Sn, Sb and Cr is particularly preferable among these elements.

The remainder of the composition of steel sheet of the present invention is incidental impurities and Fe. Examples of the incidental impurities include O, B, Ti, Nb, V, as well as Ni, Sn, Sb, Cu, P, Mo, Cr or the like having contents in steel below the aforementioned lower limits.

Either a slab may be prepared by the conventional ingot-making or continuous casting method, or a thin cast slab/strip having thickness of 100 mm or less may be prepared by direct continuous casting, from molten steel having the component composition described above. The slab may be either heated by the conventional method to be fed to hot rolling or directly subjected to hot rolling after the casting process without being heated. In a case of a thin cast slab/strip, the slab/strip may be either hot rolled or directly fed to the next process skipping hot rolling.

A hot rolled steel sheet (or the thin cast slab/strip which skipped hot rolling) is then subjected to annealing according to necessity. The hot rolled steel sheet or the like is preferably annealed at temperature in the range of 800° C. to 1100° C. (inclusive of 800° C. and 1100° C.) to ensure highly satisfactory formation of Goss texture in a resulting product steel sheet. When the hot rolled steel sheet or the like is annealed at temperature lower than 800° C., band structure derived from hot rolling is retained, thereby making it difficult to realize primary recrystallized structure constituted of uniformly-sized grains and inhibiting smooth proceeding of secondary recrystallization. When the hot rolled steel sheet or the like is annealed at temperature exceeding 1100° C., grains of the hot rolled steel sheet after annealing are exceedingly coarsened, which is very disadvantageous in terms of realizing primary recrystallized structure constituted of uniformly-sized grains.

The hot rolled steel sheet thus annealed is subjected to a single cold rolling process or two or more cold rolling processes optionally interposing intermediate annealing therebetween, then recrystallization annealing process, and coating process of providing the steel sheet with annealing separator thereon. It is effective to carry out the cold rolling process(s) after raising the temperature of the steel sheet to 100° C. to 250° C. and also implement a single aging treatment or two or more aging treatments at temperature in the range of 100° C. to 250° C. during the cold rolling in terms of satisfactory formation of Goss texture of the steel sheet. Formation of an etching groove for magnetic domain refining after cold rolling is fully acceptable in the present invention.

The primary recrystallization annealing necessitates rapid heating of the steel sheet or the like at a heating rate of at least 150° C./s to reliably improve primary recrystallized texture of the steel sheet, as described above. The upper limit of the heating rate in the rapid heating is preferably 600° C./s in terms of curbing production cost. Direct heating methods such as induction heating and electrical resistance heating are preferable as the type of the rapid heating in terms of achieving good production efficiency. The rapid heating process is carried out until the lowest temperature in the widthwise direction of the steel sheet reaches 700° C. or higher. The upper limit of the rapid heating temperature is 820° C. in terms of curbing production cost. The upper limit of the rapid heating temperature is preferably equal to or lower than the soaking temperature.

The primary recrystallization annealing process necessitates cooling to temperature equal to 700° C. or lower after the rapid heating because unevenness in temperature distribution in the sheet widthwise direction generated during the rapid heating must be eliminated no later than completion of the soaking process of the steel sheet. The cooling is to be carried out such that the highest temperature of the steel sheet in the widthwise direction thereof is 700° C. or lower. The lower limit of the cooling temperature is 500° C. in terms of curbing cost. Gas cooling is preferable as the type of cooling. The heating rate thereafter to the soaking temperature is to be restricted to 40° C./s or lower for a similar reason, i.e. to eliminate unevenness in temperature distribution in the sheet widthwise direction of the steel sheet. The lower limit of the aforementioned "heating rate to the soaking temperature" is preferably 5° C./s or higher in terms of cost efficiency. The heating to the soaking temperature is preferably carried out by indirect heating which is less likely to generate uneven temperature distribution than other heating types. Among the indirect heating such as atmosphere heating, radiation heating and the like, atmosphere heating (e.g. gas heating by radiant tube heaters) generally employed in a continuous annealing furnace is preferable in terms of cost and maintenance performances. The soaking temperature is preferably set to be in the range of 800° C. to 950° C. in terms of optimizing driving force of secondary recrystallization in the subsequent secondary recrystallization annealing.

Examples of a facility system for carrying out such primary recrystallization annealing of a steel sheet as described above include a continuous annealing furnace constituted of: rapid heating zone, first cooling zone, heating zone, soaking zone, and second cooling zone. It is preferable that the rapid heating zone carries out the heating process of heating the steel sheet to temperature equal to or higher than 700° C. at heating rate of at least 150° C./s, the first cooling zone carries out the cooling process of cooling the steel sheet to 700° C. or lower, and the heating zone carries out the heating process of heating the steel sheet at heating rate of 40° C./s or less, respectively.

Although oxidizability of atmosphere during the primary recrystallization annealing is not particularly restricted, the oxidizability is preferably set such that $PH_2O/PH_2 \leq 0.05$ and more preferably set such that $PH_2O/PH_2 \leq 0.01$ in a case where iron loss properties in the sheet widthwise and longitudinal directions are to be further stabilized. Variations in nitriding behavior of a steel sheet in the widthwise and longitudinal directions thereof during secondary recrystallization proceeding in tight coil annealing are significantly suppressed by curbing formation of subscale during the primary recrystallization annealing by specifically setting the oxidizability of atmosphere as described above.

Secondary recrystallization annealing is to follow the primary recrystallization annealing. Surfaces of the steel sheet are to be coated with an annealing separator containing MgO as a primary component after the primary recrystallization annealing and then the steel sheet thus coated is subjected to secondary recrystallization annealing in a case where a forsterite film is to be formed on the steel sheet. In a case where a forsterite film need not be formed on the steel sheet, the steel sheet is to be coated with a known annealing separator such as silica powder, alumina powder or the like, which is not reacted with the steel sheet, i.e. which does not form subscale on the steel sheet surfaces, and then the steel sheet thus coated is subjected to secondary recrystallization annealing. Tension coating is then formed on the surfaces of the steel sheet thus obtained. A known method for forming tension coating is applicable to the present invention, without necessitating any specific restriction thereon. For example, a ceramic coating made of nitride, carbide or carbonitride can be formed by vapor deposition such as CVD, PVD and the like. The steel sheet thus obtained may further be irradiated with laser, plasma flame, or the like for magnetic domain refining in order to further reduce iron loss.

It is possible to stably obtain a good iron loss reducing effect, caused by rapid heating on an inhibitor-free steel sheet, and thus stably manufacture an inhibitor-free grain oriented electrical steel sheet exhibiting less iron loss than the prior art by employing the method for manufacturing a grain oriented electrical steel sheet of the present invention described above.

Example

Each of slab samples as shown in Table 6 was manufactured by continuous casting, heated at 1410° C., and hot rolled to be finished to a hot rolled steel sheet having sheet thickness: 2.0 mm. The hot rolled steel sheet thus obtained was annealed at 950° C. for 180 seconds. The steel sheet thus annealed was subjected to cold rolling so as to have sheet thickness: 0.75 mm and then intermediate annealing at 830° C. for 300 seconds at oxidizability of atmosphere ($PH_2O/PH_2$) of 0.30. Thereafter, subscales at surfaces of the steel sheet were removed by pickling with hydrochloric acid and the steels sheet was subjected to cold rolling again to obtain a cold rolled steel sheet having thickness: 0.23 mm. Grooves with 5 mm spaces therebetween were formed by etching for magnetic domain refining treatment at surfaces of the cold rolled steel sheet thus obtained. The steel sheet was then subjected to primary recrystallization annealing under the conditions of the soaking temperature: 840° C. and the retention time: 200 seconds. The details of the conditions of the primary recrystallization annealing are shown in Table 7. Thereafter, the steel sheet was subjected to electrostatic coating with colloidal silica and batch annealing for the purpose of secondary recrystallization and purification at 1250° C. for 30 hours under $H_2$ atmosphere. Respective smooth surfaces without forsterite film of the steel sheet thus obtained were provided with TiC formed thereon under an atmosphere of mixed gases including $TiCl_4$, $H_2$ and $CH_4$. The steel sheet was then provided with insulation coating constituted of 50% colloidal silica and magnesium phosphate, whereby a final product was obtained. The magnetic properties of the final product were evaluated. Results of the evaluation are shown in Table 7.

Iron loss properties were evaluated for each sample steel sheet by collecting test pieces from three sites in the longitudinal direction of a resulting coil, i.e. a rear end portion in the longitudinal direction of an outer winding portion, a rear end portion in the longitudinal direction of an inner winding portion, and the center portion in the longitudinal direction of an intermediate winding portion of the coil.

It is understood from Table 7 that very good iron loss properties were obtained in the samples prepared under the relevant conditions within the present invention. In contrast, every sample where at least one of the manufacturing conditions thereof was out of the range of the present invention ended up with unsatisfactory iron loss properties.

TABLE 6

| Slab composition ID | C(%) | Si(%) | Mn(%) | Al(ppm) | N(ppm) | S(ppm) | Se(ppm) | Ni(%) | Cu(%) | P(%) | Mo(%) | Cr(%) | Sb(ppm) | Sn(ppm) |
|---|---|---|---|---|---|---|---|---|---|---|---|---|---|---|
| A | 0.07 | 3.15 | 0.05 | 70 | 30 | 6 | 5 | 0.01 | 0.01 | 0.01 | 0.002 | 0.01 | 10 | 10 |
| B | 0.05 | 3.25 | 0.05 | 40 | 35 | 7 | 5 | 0.01 | 0.01 | 0.01 | 0.002 | 0.01 | 10 | 10 |
| C | 0.03 | 3.10 | 0.05 | 30 | 40 | 6 | 10 | 0.01 | 0.01 | 0.01 | 0.001 | 0.01 | 10 | 10 |
| D | 0.02 | 3.15 | 0.05 | 50 | 20 | 5 | 10 | 0.01 | 0.01 | 0.01 | 0.002 | 0.01 | 280 | 10 |
| E | 0.01 | 3.10 | 0.05 | 20 | 10 | 5 | 8 | 0.01 | 0.01 | 0.01 | 0.002 | 0.01 | 10 | 350 |
| F | 0.05 | 3.15 | 0.06 | 40 | 50 | 10 | 7 | 0.01 | 0.01 | 0.01 | 0.002 | 0.01 | 270 | 350 |
| G | 0.06 | 3.25 | 0.02 | 30 | 30 | 10 | 5 | 0.01 | 0.01 | 0.01 | 0.001 | 0.06 | 270 | 320 |
| H | 0.05 | 3.30 | 0.05 | 50 | 40 | 15 | 10 | 0.01 | 0.01 | 0.01 | 0.001 | 0.06 | 10 | 10 |
| I | 0.08 | 3.15 | 0.02 | 30 | 20 | 20 | 6 | 0.01 | 0.01 | 0.01 | 0.01 | 0.01 | 10 | 10 |
| J | 0.07 | 3.05 | 0.01 | 20 | 35 | 20 | 6 | 0.01 | 0.07 | 0.01 | 0.002 | 0.01 | 10 | 10 |
| K | 0.03 | 3.15 | 0.05 | 50 | 30 | 5 | 5 | 0.07 | 0.01 | 0.01 | 0.002 | 0.01 | 10 | 10 |
| L | 0.01 | 3.20 | 0.05 | 60 | 30 | 5 | 5 | 0.01 | 0.01 | 0.09 | 0.002 | 0.01 | 550 | 10 |
| M | 0.02 | 2.95 | 0.05 | 30 | 20 | 10 | 8 | 0.01 | 0.01 | 0.2 | 0.02 | 0.01 | 10 | 10 |
| N | 0.02 | 2.85 | 0.03 | 20 | 30 | 5 | 10 | 0.01 | 0.2 | 0.01 | 0.002 | 0.06 | 10 | 10 |

TABLE 7

| No. | Slab composition ID | Oxidizability of atmophere during primary recystallizaiton annealing ($PH_2O/PH_2$) | Rapid heating zone: Heating type | Rapid heating zone: Heating rate (° C./s) | Rapid heating zone: End-point temperature of steel sheet (° C.) | Cooling zone (gas cooling): Steel sheet temperature at completion of cooling (° C.) | Heating zone: Heating type | Heating zone: Heating rate (° C./s) | Iron loss properties $W_{17/50}$(W/kg): Outer winding | Iron loss properties $W_{17/50}$(W/kg): Intermediate winding | Iron loss properties $W_{17/50}$(W/kg): Inner winding | Note |
|---|---|---|---|---|---|---|---|---|---|---|---|---|
| 1 | A | 0.005 | Induction heating | 50 | 730 | 650 | Gas heating by radiant tube heater | 20 | 0.77 | 0.76 | 0.77 | Comp. Example |
| 2 | | 0.005 | | 300 | 730 | 650 | | 20 | 0.67 | 0.68 | 0.67 | Present Example |
| 3 | | 0.33 | | 300 | 730 | 650 | | 20 | 0.66 | 0.70 | 0.69 | Present Example |
| 4 | | 0.005 | | 300 | 730 | 720 | | 20 | 0.78 | 0.77 | 0.77 | Comp. Example |
| 5 | B | 0.25 | Electrical resistance heating | 600 | 650 | 650 | | 30 | 0.80 | 0.81 | 0.84 | Comp. Example |
| 6 | | 0.31 | | 600 | 820 | 650 | | 30 | 0.70 | 0.68 | 0.72 | Present Example |
| 7 | | 0.30 | | 600 | 820 | 600 | | 60 | 0.82 | 0.82 | 0.86 | Comp. Example |
| 8 | | 0.31 | | 600 | 820 | 750 | | 30 | 0.81 | 0.85 | 0.81 | Comp. Example |
| 9 | C | 0.005 | Induction heating | 200 | 600 | 650 | | 30 | 0.78 | 0.78 | 0.78 | Comp. Example |
| 10 | | 0.005 | | 100 | 700 | 650 | | 20 | 0.77 | 0.78 | 0.78 | Comp. Example |
| 11 | | 0.005 | | 200 | 700 | 650 | | 20 | 0.68 | 0.68 | 0.68 | Present Example |
| 12 | | 0.005 | | 200 | 700 | 650 | | 50 | 0.78 | 0.79 | 0.79 | Comp. Example |
| 13 | D | 0.30 | Electrical resistance heating | 400 | 800 | 700 | | 30 | 0.73 | 0.69 | 0.71 | Present Example |
| 14 | | 0.32 | | 400 | 800 | 700 | | 50 | 0.80 | 0.76 | 0.78 | Comp. Example |
| 15 | E | 0.25 | | 400 | 800 | 780 | | 50 | 0.88 | 0.77 | 0.76 | Comp. Example |
| 16 | | 0.28 | | 400 | 800 | 500 | | 30 | 0.65 | 0.69 | 0.66 | Present Example |
| 17 | F | 0.30 | Induction heating | 300 | 730 | 650 | | 60 | 0.78 | 0.76 | 0.80 | Comp. Example |
| 18 | | 0.32 | | 300 | 730 | 650 | | 20 | 0.69 | 0.68 | 0.72 | Present Example |
| 19 | G | 0.25 | | 180 | 730 | 650 | | 10 | 0.73 | 0.71 | 0.75 | Present Example |
| 20 | | 0.28 | | 100 | 600 | 550 | | 10 | 0.82 | 0.80 | 0.84 | Comp. Example |
| 21 | H | 0.001 | Electrical resistance heating | 400 | 760 | 500 | | 5 | 0.69 | 0.69 | 0.69 | Present Example |
| 22 | | 0.45 | | 400 | 760 | 500 | | 5 | 0.68 | 0.72 | 0.70 | Present Example |

TABLE 7-continued

| No. | Slab composition ID | Oxidizability of atmophere during primary recystallizaiton annealing ($PH_2O/PH_2$) | Rapid heating zone: Heating type | Rapid heating zone: Heating rate (° C./s) | Rapid heating zone: End-point temperature of steel sheet (° C.) | Cooling zone (gas cooling): Steel sheet temperature at completion of cooling (° C.) | Heating zone: Heating type | Heating zone: Heating rate (° C./s) | Iron loss properties $W_{17/50}$(W/kg): Outer winding | Iron loss properties $W_{17/50}$(W/kg): Intermediate winding | Iron loss properties $W_{17/50}$(W/kg): Inner winding | Note |
|---|---|---|---|---|---|---|---|---|---|---|---|---|
| 23 | I | 0.001 | | 400 | 500 | 450 | | 35 | 0.81 | 0.79 | 0.83 | Comp. Example |
| 24 | | 0.001 | | 400 | 720 | 600 | | 35 | 0.72 | 0.73 | 0.72 | Present Example |
| 25 | J | 0.30 | Induction heating | 350 | 730 | 650 | | 20 | 0.70 | 0.68 | 0.72 | Present Example |
| 26 | | 0.32 | | 350 | 730 | 710 | | 10 | 0.82 | 0.80 | 0.84 | Comp. Example |
| 27 | K | 0.25 | | 350 | 725 | 500 | | 20 | 0.74 | 0.73 | 0.70 | Present Example |
| 28 | | 0.28 | | 350 | 725 | 500 | | 60 | 0.84 | 0.80 | 0.83 | Comp. Example |
| 29 | L | 0.005 | Electrical resistance heating | 100 | 750 | 640 | | 15 | 0.74 | 0.74 | 0.74 | Comp. Example |
| 30 | | 0.005 | | 600 | 750 | 640 | | 15 | 0.65 | 0.65 | 0.66 | Present Example |
| 31 | M | 0.005 | | 280 | 780 | 680 | | 20 | 0.70 | 0.69 | 0.70 | Present Example |
| 32 | | 0.005 | | 280 | 780 | 720 | | 20 | 0.80 | 0.76 | 0.79 | Comp. Example |
| 33 | N | 0.03 | Induction heating | 120 | 720 | 600 | | 20 | 0.77 | 0.79 | 0.78 | Comp. Example |
| 34 | | 0.03 | | 500 | 720 | 600 | | 20 | 0.68 | 0.70 | 0.69 | Present Example |

The invention claimed is:

1. A method for manufacturing a grain oriented electrical steel sheet, comprising the steps of:

preparing a steel slab having a composition including C: 0.08 mass % or less, Si: 2.0 mass % to 8.0 mass %, Mn: 0.005 mass % to 1.0 mass %, Al: 100 ppm or less, N, S and Se: 50 ppm or less, respectively, and balance as Fe and incidental impurities;

rolling the steel slab to obtain a steel sheet having the final sheet thickness; and subjecting the steel sheet to primary recrystallization annealing and then secondary recrystallization annealing, wherein Al, N, S and Se constitute inhibitor components to be reduced, and the primary recrystallization annealing includes heating the steel sheet to temperature equal to or higher than 700° C. at a heating rate of at least 150° C./s, then cooling the steel sheet only to a temperature within the range of 500° C. or more and 700° C. or lower, then heating the steel sheet to soaking temperature at an average heating rate not exceeding 40° C./s, and then cooling the steel sheet.

2. The method for manufacturing a grain oriented electrical steel sheet of claim 1, wherein oxidizability of an atmosphere, represented by $PH_2O/PH_2$, under which the primary recrystallization annealing is carried out is set to be 0.05 or lower.

3. The method for manufacturing a grain oriented electrical steel sheet of claim 1, wherein the composition of the steel slab further includes at least one element selected from Ni: 0.03 mass % to 1.50 mass %, Sn: 0.01 mass % to 1.50 mass %, Sb: 0.005 mass % to 1.50 mass %, Cu: 0.03 mass % to 3.0 mass %, P: 0.03 mass % to 0.50 mass %, Mo: 0.005 mass % to 0.10 mass %, and Cr: 0.03 mass % to 1.50 mass %.

4. The method for manufacturing a grain oriented electrical steel sheet of claim 1, wherein the rolling step comprises subjecting the steel slab to hot rolling and then either a single cold rolling process or two or more cold rolling processes interposing intermediate annealing(s) therebetween to obtain a steel sheet having the final sheet thickness.

5. The method for manufacturing a grain oriented electrical steel sheet of claim 2, wherein the composition of the steel slab further includes at least one element selected from Ni: 0.03 mass % to 1.50 mass %, Sn: 0.01 mass % to 1.50 mass %, Sb: 0.005 mass % to 1.50 mass %, Cu: 0.03 mass % to 3.0 mass %, P: 0.03 mass % to 0.50 mass %, Mo: 0.005 mass % to 0.10 mass %, and Cr: 0.03 mass % to 1.50 mass %.

6. The method for manufacturing a grain oriented electrical steel sheet of claim 2, wherein the rolling step comprises subjecting the steel slab to hot rolling and then either a single cold rolling process or two or more cold rolling processes interposing intermediate annealing(s) therebetween to obtain a steel sheet having the final sheet thickness.

7. The method for manufacturing a grain oriented electrical steel sheet of claim 3, wherein the rolling step comprises subjecting the steel slab to hot rolling and then either a single cold rolling process or two or more cold rolling processes interposing intermediate annealing(s) therebetween to obtain a steel sheet having the final sheet thickness.

8. The method for manufacturing a grain oriented electrical steel sheet of claim 5, wherein the rolling step comprises subjecting the steel slab to hot rolling and then either a single cold rolling process or two or more cold rolling processes interposing intermediate annealing(s) therebetween to obtain a steel sheet having the final sheet thickness.

9. The method for manufacturing a grain oriented electrical steel sheet of claim 1, wherein the primary recrystallization annealing further includes soaking the steel sheet after heating the steel sheet to the soaking temperature and before then cooling the steel sheet.

10. The method for manufacturing a grain oriented electrical steel sheet of claim 1, wherein the primary recrystallization annealing is carried out with a continuous annealing furnace that comprises a first heating zone, a first cooling zone, a second heating zone, a soaking zone, and a second cooling zone.

* * * * *